US005576751A

United States Patent [19]

Wada et al.

[11] Patent Number: 5,576,751

[45] Date of Patent: Nov. 19, 1996

[54] APPARATUS FOR EITHER CONTINUOUS OR INTERMITTENT THERMAL TRANSFER RECORDING

[75] Inventors: Satoshi Wada, Kawasaki; Takehiro Yoshida, Tokyo; Takeshi Ono; Tomoyuki Takeda, both of Yokohama; Masaya Kondo, Tokyo; Makoto Kobayashi, Tama; Takahiro Kato; Takashi Awai, both of Yokohama; Yasushi Ishida, Tokyo; Akihiro Tomoda, Yokohama; Minoru Yokoyama, Yokohama; Masakatsu Yamada, Yokohama, all of Japan

[73] Assignee: Canon Kabushiki Kaisha, Tokyo, Japan

[21] Appl. No.: 412,206

[22] Filed: Mar. 27, 1995

Related U.S. Application Data

[63] Continuation of Ser. No. 44,101, Apr. 6, 1993, abandoned, which is a continuation of Ser. No. 648,140, Jan. 30, 1991, abandoned.

[30] Foreign Application Priority Data

Feb. 1, 1990 [JP] Japan ..... 2-020405

[51] Int. Cl.[6] ..... B41J 2/325

[52] U.S. Cl. ..... 347/217; 347/188

[58] Field of Search ..... 347/217, 188, 347/171; 400/224.1, 224.2, 225, 232, 236, 236.2, 120.09, 120.01

[56] References Cited

U.S. PATENT DOCUMENTS 4,456,392 6/1984 Nozaki et al. ..... 400/120

FOREIGN PATENT DOCUMENTS 59-95177 6/1984 Japan .
61-197256 1/1986 Japan .
62-167059 7/1987 Japan .

OTHER PUBLICATIONS

Eur. Pat. Off. Search Report for Eur. Pat. App. No. 91101290.4.

*Primary Examiner*—Huan H. Tran
*Attorney, Agent, or Firm*—Fitzpatrick, Cella, Harper & Scinto

[57] ABSTRACT

In a thermal transfer recording apparatus, an ink sheet and a recording medium are conveyed relative to each other, and an image is recorded by transferring ink from the ink sheet onto the recording medium. The apparatus includes a detector which detects whether the recording is continuous or intermittent, and a controller which changes the amount by which the ink sheet is conveyed in accordance with the detected result.

31 Claims, 8 Drawing Sheets

| FIG. 5A | FIG. 5B |
|---|---|

APPARATUS FOR EITHER CONTINUOUS OR INTERMITTENT THERMAL TRANSFER RECORDING

This application is a continuation of application Ser. No. 08/044,101 filed Apr. 6, 1993 now abandoned, which is a continuation of application Ser. No. 07/648,140 filed Jan. 30, 1991 now abandoned.

BACKGROUND OF THE INVENTION

1. Field of the Invention

The present invention relates to a thermal transfer recording apparatus, which records an image on a recording medium by transferring ink of an ink sheet on the recording medium, and a facsimile apparatus using this apparatus.

2. Related Background Art

A thermal transfer printer generally uses an ink sheet obtained by applying heat fusible (or heat sublimable) ink on a base film, and selectively heating the ink sheet in accordance with the image signal by a thermal head to transfer the fused (or sublimated) ink on the recording sheet for image recording. Since the ink is generally transferred completely to the recording sheet (so-called one-time sheet) by recording the image at a time on this ink sheet, after recording the image of one character or one line, it was necessary to convey the ink sheet by a length corresponding to the length of the recording, and next to securely bring a portion, on which the ink sheet has not yet been used, to the next position to be recorded.

Since this increases the usage of the ink sheets, the running cost for the thermal transfer printer has had a tendency to be higher than that for an ordinary thermal printer which records on thermal paper.

To solve this problem at issue, a thermal transfer printer has been proposed which the recording sheet and ink sheet are conveyed to provide a difference in speed as shown in the Publication of U.S. Pat. No. 4,456,392, Japanese Laid-Open Patent Application No. 58-201686 and Japanese Patent Publication No. 62-58917. As specified in the above publications, an ink sheet (multi-print sheet) capable of recording the image plural (n) times is known.

When the length of recording is L and is continuously recorded, a length of conveyance of the ink sheet, which is conveyed after recording each image or while the image is being recorded, can be made smaller than its length L (L/n:n>1) for recording by using this ink sheet. This increases the usage efficiency of ink sheet n times conventional one, and the reduction in the running cost of the thermal transfer printer can be expected. Hereinafter this recording system is called "Multi-print".

When generally recording in a facsimile apparatus, etc., while receiving image signals, the recording time interval for one line does not remain constant, causing so-called intermittent recording because the time needed to decode image signals after receiving differs with image signals for each line. However, in a facsimile apparatus equipped with a large capacity image memory, which records images after storing the received image signal in its memory once, it is possible to record at uniform speed by making the recording time interval for one line constant.

In an ordinary thermal transfer printer, the uniform speed recording (such as continuous recording), in which the recording time interval for each line is constant facilitates recording because of predictable heat dissipation, etc. of the thermal head, and so is superior in the quality of recording because recording density variation decreases. If, therefore, the above n value is fixed to meet such an uniform speed recording, the difference in quality of recording between uniform speed recording and intermittent recording is likely to conspicuously appear when both recordings are performed.

SUMMARY OF THE INVENTION

An object of the present invention is to provide a high quality of picture thermal transfer recording apparatus and facsimile apparatus using the apparatus.

It is another object of the present invention to provide a thermal transfer recording apparatus capable of recording without degrading the quality of picture even if the recording period fluctuates, and a facsimile apparatus using this apparatus.

It is another object of the present invention to provide a thermal transfer recording apparatus capable of recording an image without degrading the quality of picture even if the recording period fluctuates by the following method, and a facsimile apparatus using the apparatus: this method has been worked out in view of the above conventional example, and records by changing the amount of conveyance for ink sheet against the recording medium between when the recording period fluctuates for recording and when the recording period is made almost constant for recording.

It is another object of the present invention to provide a thermal transfer recording apparatus, which detects whether or not image data to be recorded intermittently occurs, and records by changing the amount of conveyance for the ink sheet against the recording medium in accordance with the detection result.

It is another object of the present invention to provide a facsimile apparatus, which detects whether an image data stored in a storage means, in which a received image data has been stored, will be recorded or recording will be performed by synchronizing with an image signal received by a transmitting and receiving means, and records by changing the amount of conveyance for the ink sheet against the recording medium in accordance with the detection result.

DETAILED DESCRIPTION OF THE PREFERRED EMBODIMENT

Referring to the attached drawings, a preferred embodiment of the present invention is described in detail below.

Description of Facsimile Apparatus (FIG. 1 to FIG. 4)

FIG. 1 to FIG. 4 are diagrams showing an example of the application of a thermal transfer printer using an embodiment of the present invention to a facsimile apparatus.

Figure 1:
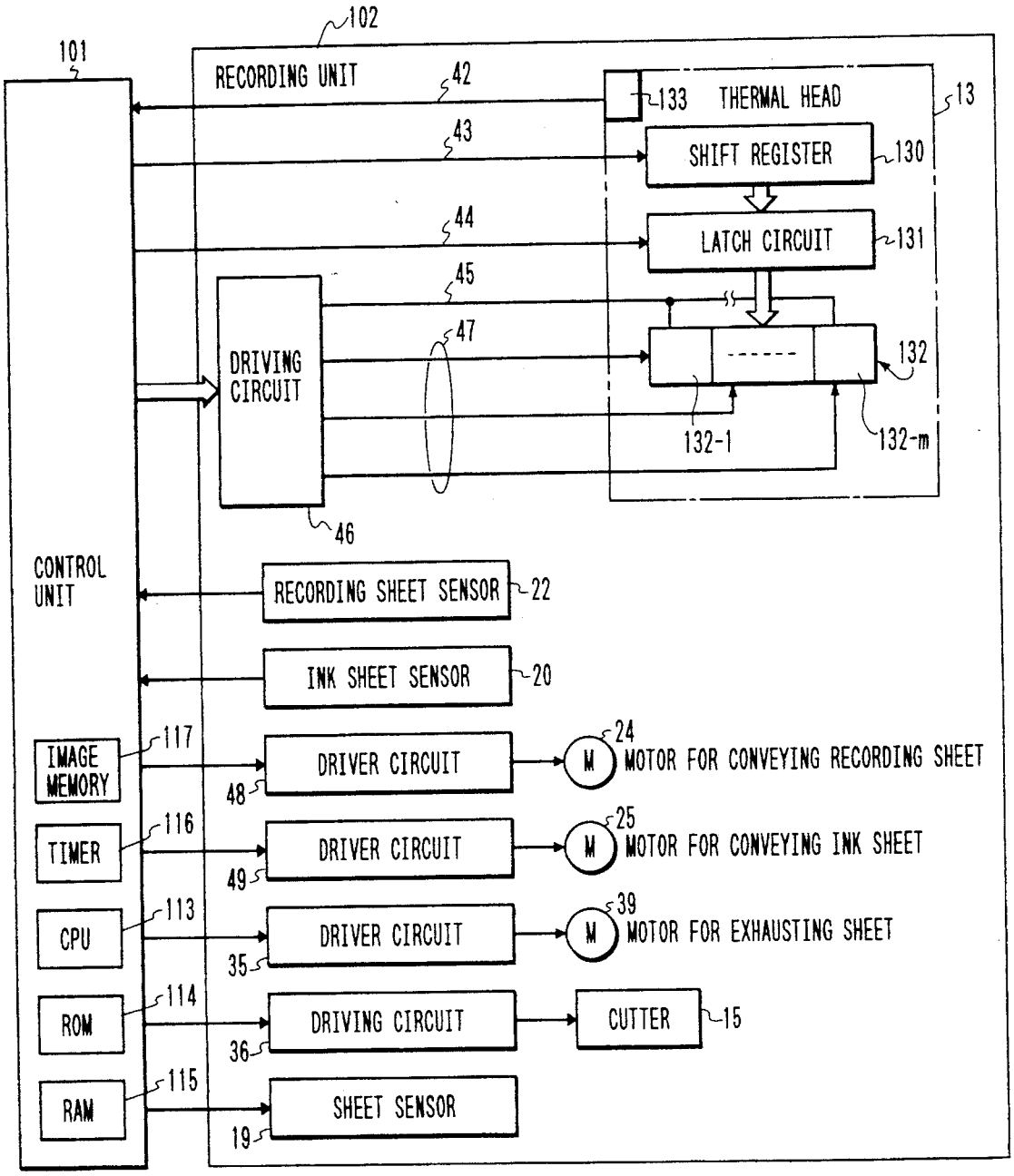
FIG. 1 is a block diagram showing electrical connections between the control unit and the recording unit in a facsimile apparatus of the embodiment.

FIG. 1 is a diagram showing electric connections between control unit 101 and recording unit 102 of the facsimile apparatus.

Figure 2:
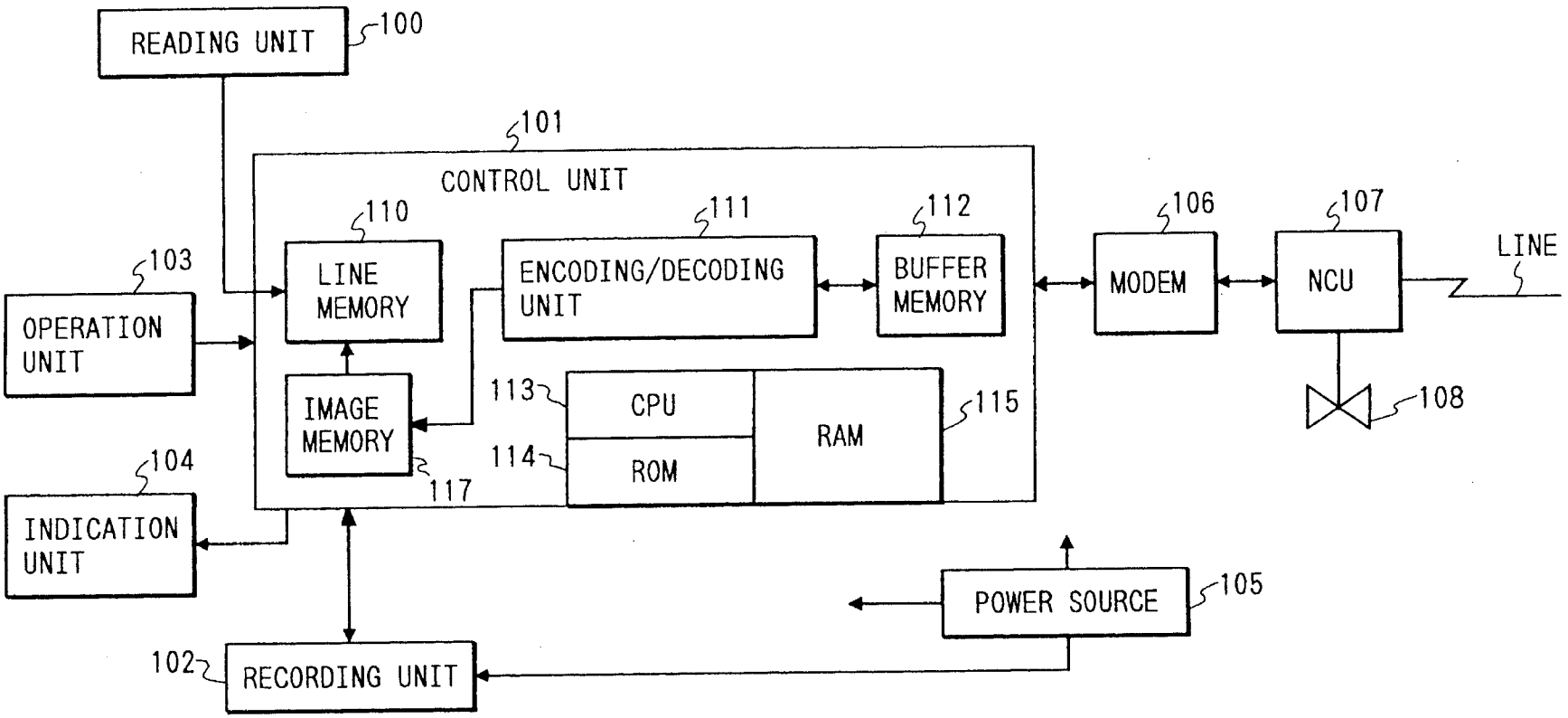
FIG. 2 is a block diagram showing the outline construction of the facsimile apparatus of the embodiment.
Figure 3:
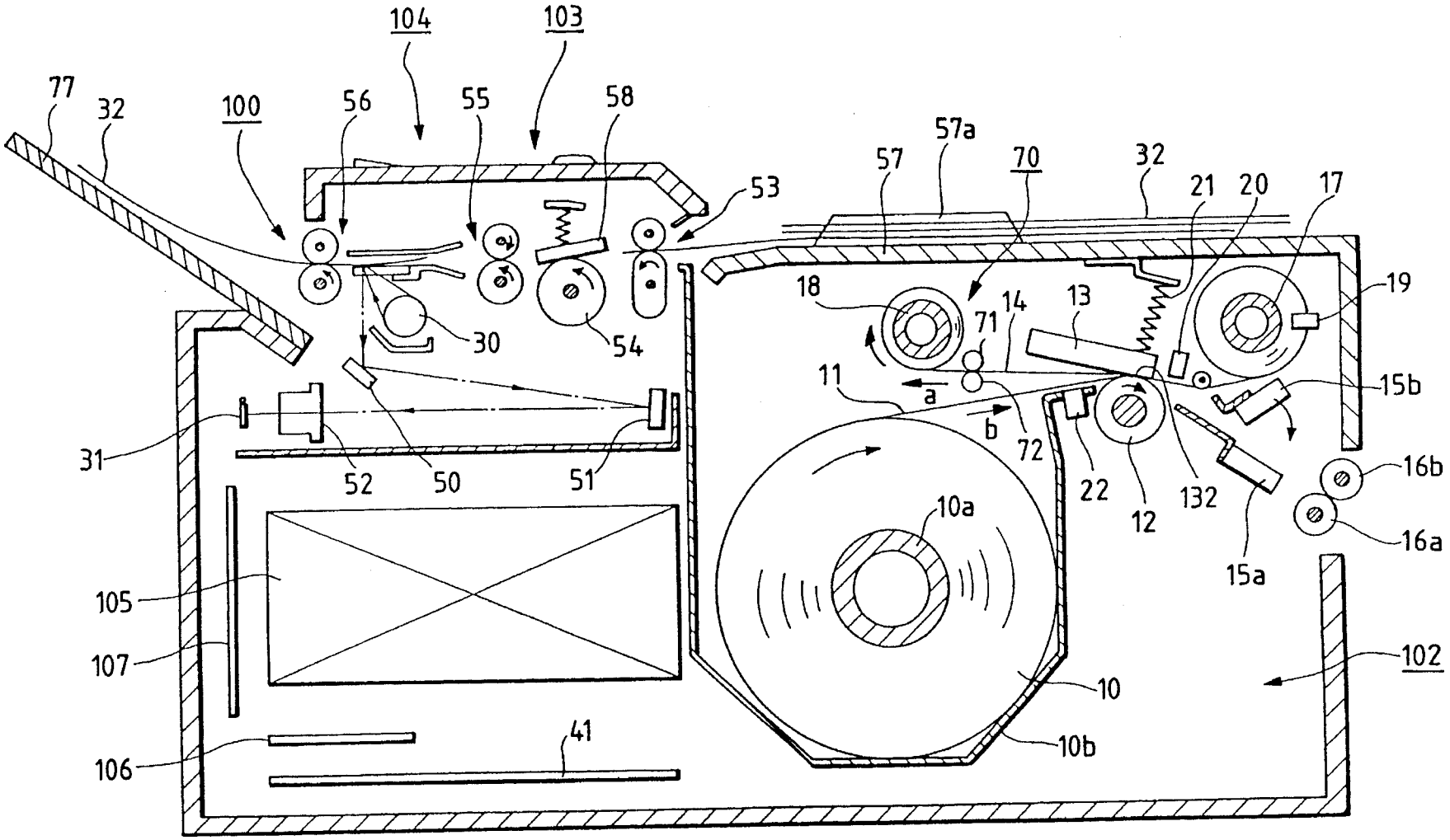
FIG. 3 is a sectional side elevation showing the construction of the recording unit in the facsimile apparatus of the embodiment.
Figure 4:
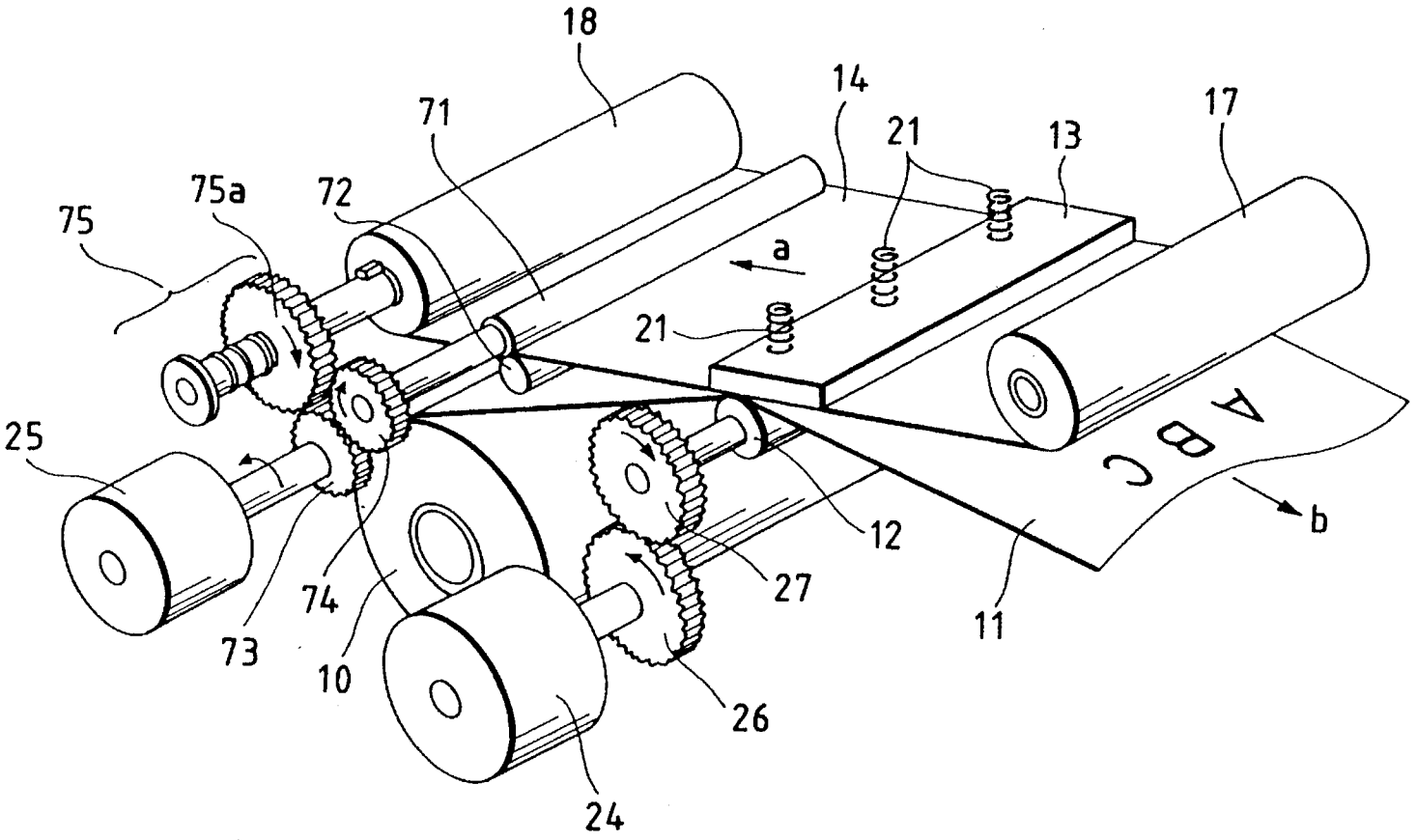
FIG. 4 is a diagram showing a conveyance mechanism for the recording sheet and ink sheet in the recording unit of the embodiment.

FIG. 2 is a block diagram showing the outline construction of the facsimile apparatus. FIG. 3 is a sectional side elevation showing the facsimile apparatus. FIG. 4 is a diagram showing a conveyance mechanism for the recording sheet and the ink sheet.

Referring to FIG. 2, the outline construction of a facsimile apparatus of the embodiment is described.

In FIG. 2, a reading unit 100 photoelectrically reads a manuscript and its output is sent to a control unit 101 as a digital image signal. It is equipped with a motor for conveying the manuscript, CCD image sensor, etc.

Then the construction of this control unit 101 is described. A line memory 110 stores image data for each line, stores image data for one line from the reading unit 100 when the manuscript is transmitted or copied, and also stores the received image data for one line that has been decoded when image data is received. When the stored data is output to a recording unit 102, the image is formed. An encoding/decoding unit 111 encodes an image information to be transmitted by using the MH coding method, etc., and at the same time, decodes the received coded image data into image data.

An image data produced by decoding by the encoding/decoding unit 111 is successively stored in a image memory 117 as receiving as a substitutes for a memory when, for example, there is no recording sheet in the recording unit 102.

When it has become possible to record by the recording unit 102, one line image data to be recorded is successively sent to the recording unit 102 for recording. Also when it is possible for the recording unit 102 to record on receiving an image signal, the image data decoded by the encoding/decoding unit 111 is successively transmitted to the recording unit 102 for recording and reproduction.

A buffer memory 112 stores coded image data that will be transmitted or has been received. Each portion of the control unit 101 is controlled by CPU 113 such as a microprocessor. The control unit 101 is provided with ROM 114, in which a control program for CPU 113 and various data are stored, RAM 115, in which various data are temporarily stored as a work area for CPU 113, and the like in addition to the CPU 113.

A recording unit 102 has a thermal line head, and records an image on recording sheet by using the thermal transfer recording method. The construction will be described in detail referring to FIG. 3 later. An operation unit 103 includes various function keys, input keys for telephone numbers, etc. An indication unit 104 is normally adjacent to the operation unit 103, and displays conditions, etc. of various functions and apparatus. A power source 105 supplies power for the entire apparatus. Also, 106 is a MODEM (modulator and demodulator), and 108 is a telephone set. A network control unit (NCU) 107 automatically answers by detecting ring tone, and controls lines.

The construction of the recording unit 102 will be described in detail referring to FIG. 3. The portions in common in each drawing are shown by the same reference numerals.

In FIG. 3, paper roll 10 is recording sheet 11, of ordinary paper, rolled around a core 10*a* like a roller. This paper roll 10 is rotatably housed within the apparatus so that recording sheet 11 can be fed to a thermal head 13 by rotation in the direction of the arrow of a platen roller 12. The rolled paper 10 is loaded in a paper roll loading unit 10*b* so that the paper roll can be attached and detached. A platen roller 12 conveys recording paper 11 in the arrow "b" direction, and at the same time, presses ink sheet 14 and recording paper 11 between the platen roller 12 and a heater element 132 of the thermal head 13.

Recording sheet 11, on which image recording has been performed by heat generation of thermal head 13, is conveyed toward discharge rollers 16 (16*a*, 16*b*) by further rotation of the platen roller 12. When image recording for one page has been completed, it is cut on a page basis by meshing of rotary cutters 15 (15*a*, 15*b*).

An ink sheet feed roll 17 rolls ink sheet 14. An ink sheet wind-up roll 18 is driven by a motor for conveying the ink sheet as mentioned later to wind up ink sheet 14 in the arrow "a" direction. The ink sheet feed roll 17 and ink sheet wind-up roll 18 are loaded in an ink sheet loading unit 70 within the apparatus main body so that they can be attached and detached. A sensor 19 detects the residual quantity of the ink sheet 14, and the conveying speed of the ink sheet 14.

An ink sheet sensor 20 detects the presence of the ink sheet 14, and a spring 21 presses the thermal head 13 against the platen roller 12 through the recording sheet 11 and ink sheet 14. A recording sheet sensor 22 detects the presence of the recording sheet.

Next, the construction of the reading unit 100 is described. In the figure, a light source 30 irradiates a manuscript 32, and light reflected from the manuscript 32 is input into a CCD sensor 31 through an optical system (mirrors 50 and 51, lens 52), and is converted into electric signal. The manuscript 32 is conveyed in accordance with the reading speed of the manuscript 32 by conveyance rollers 53, 54, 55 and 56 which are driven by a motor (not illustrated) for conveying the manuscript.

Manuscript 32 consisting of plural sheets loaded on a manuscript loading stand 57 is separated into individual sheets by the cooperation of a conveyance roller 54 and pressing separation piece 58 while being guided by a slider 57*a*. Then it is conveyed into the reading unit 100, and is discharged to a tray 77 after reading.

The main portion of the control unit 101 is composed of a control substrate 41, from which various control signals are output to each portion of the apparatus. A power source 105 supplies power to each portion, and a NCU substrate unit 107 has an repeating function with telephone lines. 106 is a MODEM substrate unit.

FIG. 4 shows in detail the conveyance mechanism for the ink sheet 14 and recording sheet 11.

In FIG. 4, a motor for conveying the recording sheet 24 drives the platen roller 12 to convey the recording sheet 11 in the arrow "b" direction, which is opposite to the arrow "a" direction.

A motor for conveying ink sheet 25 conveys ink sheet 14 in the arrow "a" direction through capstan roller 71 and pinch roller 72.

Transmission gears 26 and 27 transmit the rotation of the motor 24 for conveying the recording sheet to the platen roller 12. Transmission gears 73 and 74 transmit the rotation of the motor 25 for conveying the ink sheet to the capstan roller 71. 75 is a sliding clutch unit.

By setting a ratio of gears 74 to 75 so that a length of the ink sheet 14 to be wound around the wind-up roll 18 by the rotation of a gear 75*a* is greater than the length of the ink sheet to be conveyed by the capstan roller 71, the ink sheet 14 conveyed by the capstan roller 71 is securely wound around the wind-up roll 18. An amount equivalent to the difference between the amount of wind-up of the ink sheet 14 by wind-up roll 18 and an amount of ink sheet 14 fed by capstan roller 71 is absorbed by sliding clutch unit 75.

This prevents any fluctuation in conveyance speed (amount) of ink sheet 14 due to fluctuations in wind-up diameter of wind-up roll 18.

FIG. 1 is a diagram showing electrical connections between control unit 101 and recording unit 102 in a facsimile apparatus of this embodiment, and portions in common with other drawings are shown with the same drawing numbers.

Thermal head 13 is the line head. The thermal head 13 prints serial recording data for one line from the control unit 101, and is composed of a shift register 130 to input a shift clock 43, a latch circuit 131 which latches data from a shift register 130 through latch signal 44, and heat generating resistive member 132 consisting of heat generating resistor for one line. The heat generating member 132 is divided into m pieces of blocks shown by 132-1 to 132-m for driving.

A temperature sensor 133 is installed on the thermal head 13 to detect the temperature of the thermal head 13. An output signal 42 of this temperature sensor 133 is A/D converted within the control unit 101, and is input into said CPU 113. This causes CPU 113 to detect the temperature of thermal head 13, and to change the pulse width of strobe signal 47 in accordance with the temperature, or change the driving voltage, etc. of thermal head 13 in order to change the applied energy to thermal head 13 in accordance with the characteristic of ink sheet 14. In a programmable timer 116, the counting time is set by CPU 113, and counting starts when the start of counting is indicated. The programmable timer commands CPU 113 to output an interrupt signal, time-out signal, etc. at every indicated time.

This enables CPU 113 to determine the energizing time to the thermal head 13 or excitation timing of motors 24 and 25, etc. An image memory 117 stores image data that has been decoded after receiving.

Characteristic (type) of ink sheet 14 may be distinguished by detecting marks, etc. printed on the ink sheet 14, and also by marks, notches, or projection, etc. provided on the cartridge, etc. for ink sheet.

A driving circuit 46 inputs a driving signal for thermal head 13 from the control unit 101, and outputs a strobe signal 47 to drive the thermal head 13 for each block.

This driving circuit 46 is, on an indication from control unit 101, capable of changing the applied energy to the thermal head 13 by changing the voltage to be output to power line 45 which supplies current to heat generating resistive member 132 of the thermal head 13. A driving circuit 36 operates by meshing cutters 15, and includes a motor for driving the cutters, etc.

A motor 39 for discharging paper drives a roller 16 for discharging paper. Driver circuits 35, 48 and 49 drive a motor 39 for discharging paper, a motor 24 for conveying recording sheet and a motor 25 for conveying ink sheet respectively. These motors 39, 24 and 25 for discharging paper, for conveying recording sheet and for conveying ink sheet respectively use stepping motors in this embodiment, but are not limited thereto, and DC motors, for example, may be used.

Description of Recording Process (FIG. 1 to FIG. 6)

Figures 5, 5A:
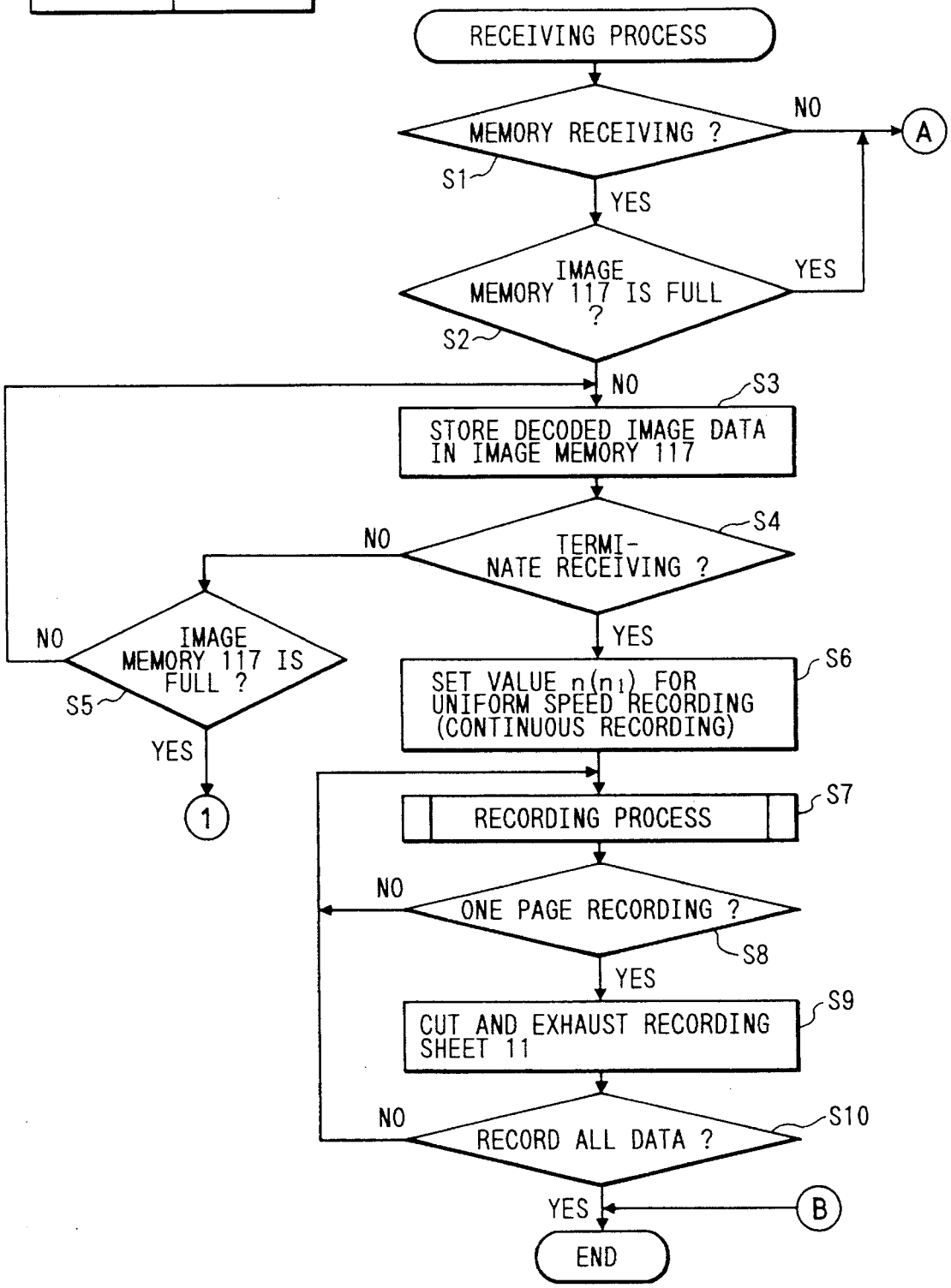
FIG. 5 is a block diagram showing that FIGS. 5A and 5B should be read as connected flowcharts.
FIGS. 5A and 5B are flowcharts.
Figure 5B:
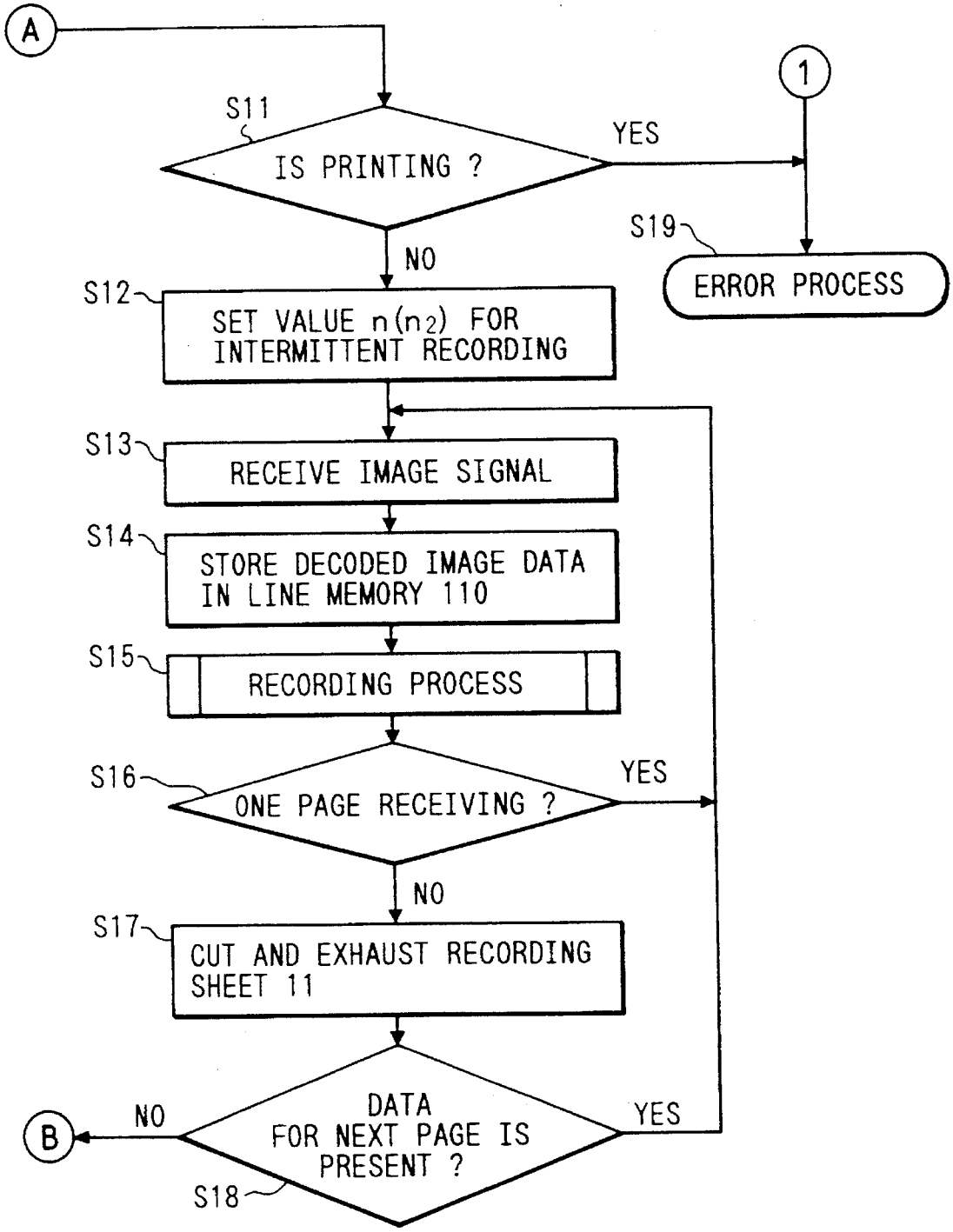

FIG. 5 is a block diagram showing that FIGS. 5A and 5B should be read as connected flowcharts.

FIGS. 5A and 5B are flowcharts showing the receiving process in a facsimile apparatus of this embodiment. This process starts by detecting an incoming call. A control program that executes this process is stored in ROM 114.

First step S1 checks whether or not it is memory receiving. In the case of memory receiving, proceed to step S2, and check whether or not image memory 117 is full. If image memory 117 is not full, proceed to step S3, and store image data decoded by the encoding/decoding unit 111 in image memory 117. In this way, image data is stored in the image memory 117 until receiving is completed in steps S4 and S5 or the image memory 117 becomes full.

After receiving image signal in step S4, proceed to step S6, and set n value ($n_1$) for uniform speed recording (for continuous recording, for example, in the case of copy mode, or recording from memory, etc.).

This is because the recording time interval for each line can be made constant since image data to be recorded is recorded while it is being read from the image memory 117 when the image is recorded. Thus, record the image for one line in step S7, and check in step S8 whether or not the image for one page has been recorded. If it is not completed, return to step S7, and record the image for the next line. For n value ($n_1$) for uniform speed recording (for continuous recording), ensure that the amount of conveyance of the ink sheet is less than that in the case of intermittent recording.

After completing the recording process for one page in step S8, proceed to step S9, and convey a specified amount of recorded recording sheet 11 in the paper discharge direction. Cut the paper on a page basis by driving the cutters 15. Then proceed to step S10, and check whether or not all image data stored in the image memory 117 has been recorded. If not, return to step S7, and carry out the above-mentioned image recording process.

On the other hand, when it is not memory receiving or memory cannot be received in step S1 or S2, proceed to step S11, and check whether or not printing is currently under way in the recording unit 102. If so, since receiving and recording cannot be performed, proceed to step S19 Error Process.

If printing is not under way in step S11, proceed to step S12, and set n value ($n_2$:$n_1$>$n_2$) for intermittent recording. Every time image data for one line is received, one line each is recorded, and the time required for receiving and decoding varies with image data received. Therefore, the n value is set taking it into consideration that the recording time interval for each line in the recording unit 102 varies.

When n is thus set to a value ($n_2$) for intermittent recording, proceed to step S13, perform receiving process for image signal. For n value ($n_2$) for intermittent recording, ensure that the amount of conveyance for the ink sheet is more than in the case of continuous recording. Then proceed to step S14, and store image data for one line, that has been decoded after receiving, in the line memory 110. In step S15, print the image data for one line by the recording unit 102.

In step S16, receive image data for one page, and check whether or not it has been recorded. If receiving of one page has not been completed, return to step S13, and perform the same operation as before to perform the receiving recording process for the next line. It can be distinguished by using, for example, RTC signal in which EOL signal is continuously given six times whether or not this one page has been completed.

After completing receiving and recording of one page, cut and discharge recording sheet 11 in the same manner as the above-mentioned step S9, and proceed to step S18. In step S18, check whether or not recording data on the next page has been transmitted.

This can be distinguished by the MPS signal of an ordinary control procedure for facsimile. When image data is present on the next page, return to step S13 to carry out the above-mentioned receiving and recording process.

Figure 6:
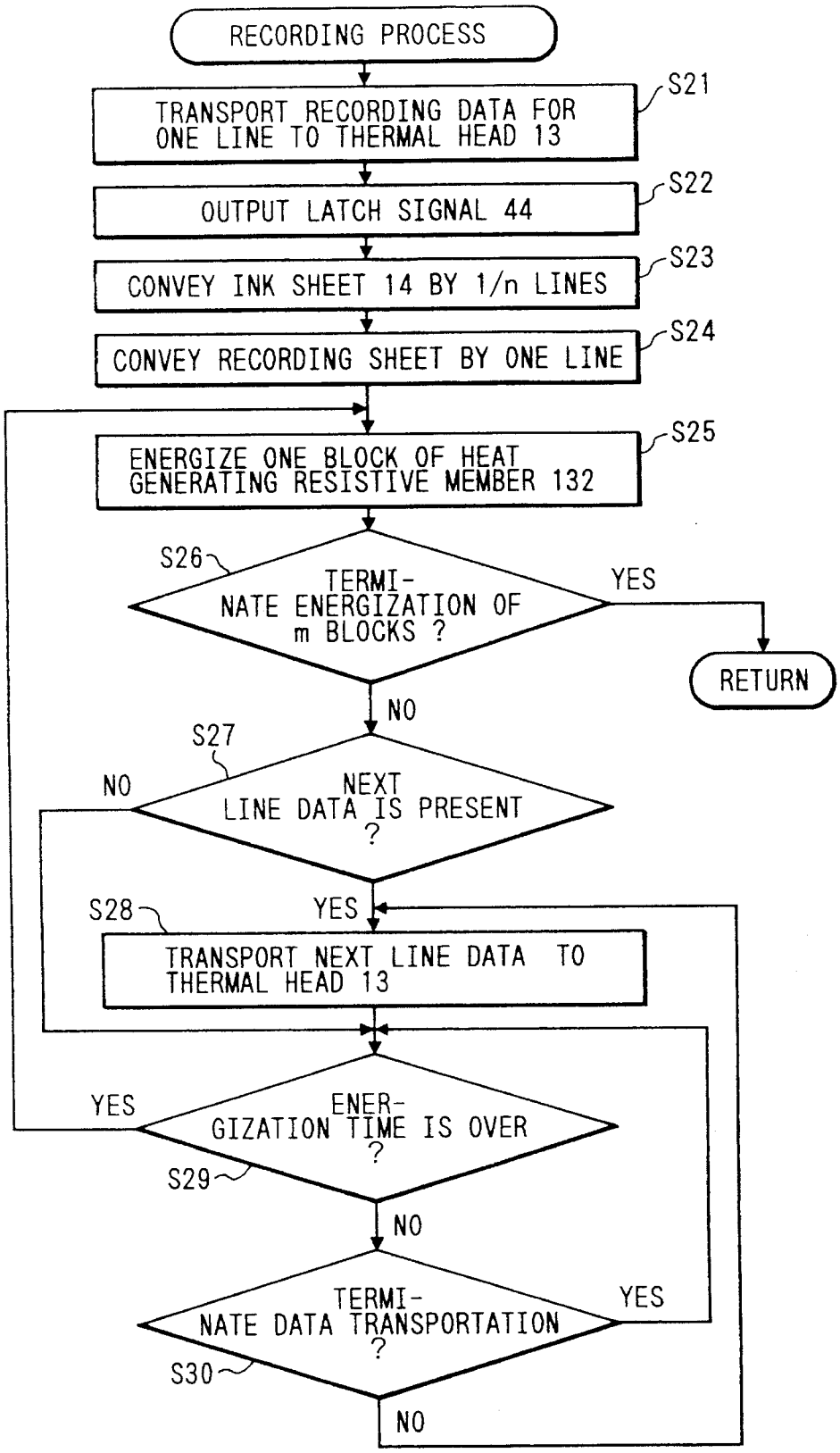
FIG. 6 is a flow chart showing the recording process in the facsimile apparatus of the embodiment.

FIG. 6 is a flow chart showing the image recording process for one line in the facsimile apparatus of the embodiment shown in steps S7 and S15 in FIGS. 5A and 5B respectively.

First in step S21, output the image data for one line stored in an image memory 117 or line memory 110 in series to the shift register 130 of the thermal head 13. After transporting recording data for one line, output latch signal 44 in step S22, and store recording data for one line in line circuit 131.

Then proceed to step S23, and drive a motor 25 for conveying the ink sheet to convey ink sheet 14 by 1/n line in the arrow "a" direction in FIG. 4. The value for n is either $n_1$ or $n_2$ as mentioned above, and has been set in accordance with whether recording proceeds at uniform speed or intermittently. Then proceed to step S24, and drive the motor 24 for conveying recording sheet to convey recording sheet 11 only by one line (1/15.4 mm in this embodiment).

In this regard, the present invention can be practiced by a device which records while the ink sheet and the recording medium are conveyed with relative speed therebetween, or while they are conveyed without relative speed therebetween, or while they are stopped.

Recording data for one line is transported to the thermal head 13, and conveyance of ink sheet 14 and recording sheet 11 is started. Then proceed to step S25, and energize one block of the heat generating resistor 132 of the thermal head 13 for transfer recording. In step S26, check whether or not energizing of m block of the heat generating resistor 132 in the thermal head. 13 has been completed. When it has not been completed, that is, when recording one line has not been completed, proceed from step S26 to S27.

In step S27, check whether or not recording data for the next line is present (when recording the image data in image memory 117). If the image data for the next line is present, proceed to step S28, and transport the image data for the next line to the shift register 130 in thermal head 13. In step S29, check whether or not the energizing time to thermal head 13 has elapsed. After energizing is over, return to step S25, and energize the next block to perform the above-mentioned image recording process.

If the energizing time has not elapsed in step S29, proceed to step S30, and check whether or not all image data for the next line have been transported. When already transported, wait in step S29 until the energizing time is over.

On the other hand, when the data transportation has not been terminated, return to step S28, and continue the data transporting process to thermal head 13. These energizing times are counted by a timer 116 of the control unit 101.

According to this embodiment, when recording the image data stored in the memory at uniform speed, set the value for n to a large one, and reduce the n value for intermittent recording in which the recording time for each line is not constant.

Therefore, when recording at uniform speed, reduce the amount of conveyance of ink sheet 14 to recording sheet 11, and during intermittent recording, increase the amount of conveyance of ink sheet 14 to recording sheet 11 in order to keep the quality of the image to be recorded almost constant in either case.

Figure 7:
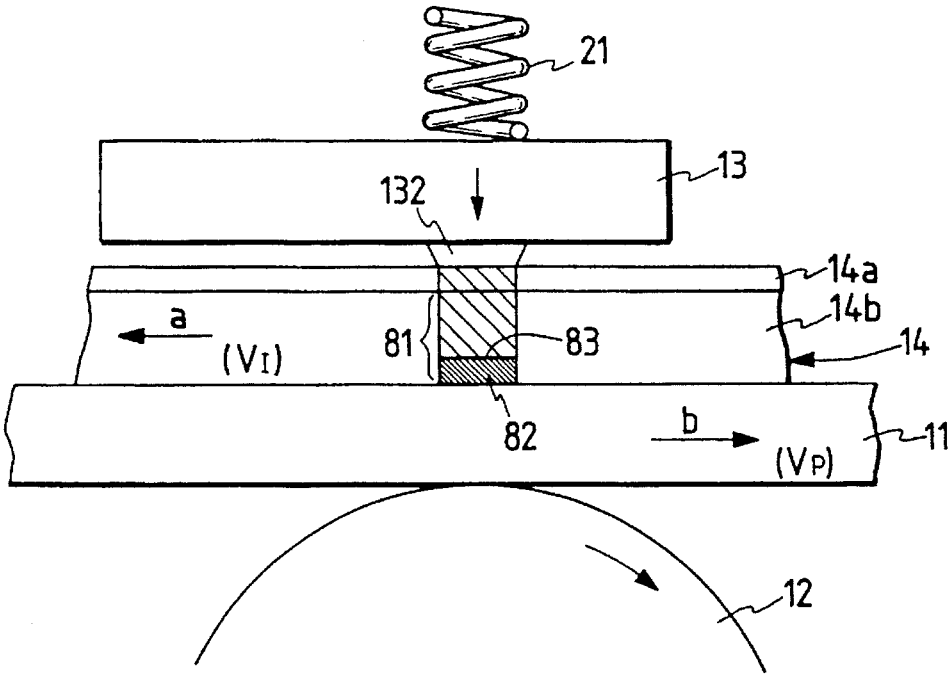
FIG. 7 is a diagram showing the state of the recording and ink sheets during recording of the embodiment.

Description of Recording Principle (FIG. 7)

FIG. 7 is a diagram showing a state of recording an image when recording the image with the recording sheet 11 conveyed in the direction opposite to the ink sheet 14 using multi-ink sheet in this embodiment.

As shown in the figure, recording sheet 11 and ink sheet 14 are held between platen roller 12 and thermal head 13, and the thermal head 13 is pressed against the platen roller 12 at a specified pressure by spring 21. The recording sheet 11 is conveyed at a speed $V_p$ in the arrow "b" direction by the rotation of the platen roller 12. On the other hand, the ink sheet 14 is conveyed at a speed $V_1$ in the arrow "a" direction by the rotation of the motor 25 for conveying the ink sheet.

When the heat generating resistor 132 of the thermal head 13 is energized by power source 105 for heating, a shaded portion 81 on the ink sheet 14 is heated.

**14*a* is a base film of the ink sheet 14, and 14*b* is an ink layer of the ink sheet 14. When the heat generating resistor 132 is energized, the ink layer 81 is heated, fusing the ink therein. A portion shown by 82 in the ink layer is transferred to the recording sheet 11. This ink layer portion 82 to be transferred corresponds to almost 1/n of the ink layer shown by 81**.

During this transfer, it is necessary to apply a shearing force for the ink in the border line 83 of the ink layer **14*b* and transfer only the ink layer portion 82 to the recording paper 11**. However, this shearing force differs depending on the temperature of the ink layer, and tends to decrease as the temperature of the ink layer increases.

Figure 8:
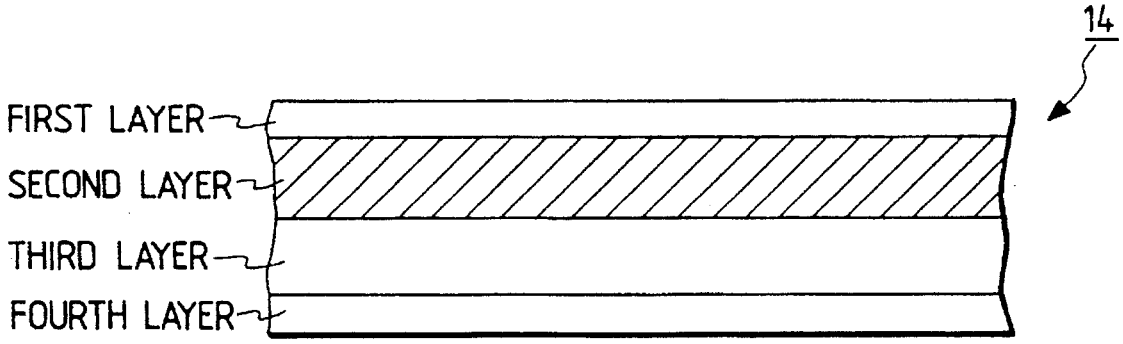
FIG. 8 is a diagram showing a sectional shape of multi-ink sheet used in the embodiment.

Description of Ink Sheet (FIG. 8)

FIG. 8 is a cross section of the ink sheet 14 used for the multi-print of this embodiment, and the ink sheet here is composed of four layers.

The second layer is the base film, a base material for the ink sheet 14. In the case of multi-print, since heat energy is applied to the same place many times, highly heat-resistant aromatic polyamide film and condenser paper are advantageous, but conventional polyester film may be used. For the thickness, it is advantageous in quality of printing to be as thin as possible from the standpoint of a role of medium, but 3 to 8 μm are desirable from the viewpoint of strength.

The third layer is an ink layer in which the recording sheet contains such an amount of ink as to transfer n times.

This ingredient has resin such as EVA as additive, carbon black or nigrosine dye for coloring, carnauba wax as a binding material, paraffin wax, etc. as the principal constituent, and is mixed to withstand repeated use for n times at the same place. For this amount of coating, 4 to 8 g/m$^2$ is desirable, and the sensitivity and density differ with the amount of coating, which can be freely selected.

The fourth layer is a portion which is not printed, and is a top coating layer to prevent the ink in the third layer from being pressure transferred, consisting of transparent wax, etc.

Accordingly, only the transparent fourth layer is pressure transferred, preventing the ground of recording sheet from becoming dirty. The first layer is a heat-resistant coating layer which protects the base film in the second layer from the heat of the thermal head 13. This is suitable for multi-print (when black information is continuously recorded) in which heat energy for n lines is likely to be applied to the same place, but it can be appropriately selected whether or not this is used. This is also effective for such a comparatively low heat-resistant base film as polyester film.

The construction of the ink sheet 14 is not limited to this embodiment, but, for example, a construction consisting of a base layer and a porous ink holding layer containing ink provided on one side of the base layer may be used, and another construction, in which a heat-resistant ink layer having a fine porous net structure is provided on the base film and its ink layer contains ink, may be used.

For the material for base film, film or paper consisting of, for example, polyamide, polyethylene, polyester, polyvinyl chloride, triacetyl cellulose, nylon, etc. may be used.

Though a heat-resistant coating layer is not always required, for the material, for example, silicone resin, epoxy resin, fluoroplastic, ethylcellulose, etc. may be used.

As an example of ink sheet having heat sublimable ink, an ink sheet is cited in which spacer particles formed with guanamine resin and fluoroplastic, and coloring material layer containing dye have been provided on a substrate formed with polyethylene terephthalate, polyethylene naphthalate, aromatic polyamide film, etc.

Also the heating system in the thermal transfer printer is not limited to the thermal head system using the above-mentioned thermal head, but the energizing system or laser transfer system, for example, may be used.

In the above-mentioned embodiment, an example using the thermal line head has been used for description, but the printer is not limited to this, and a so-called serial type thermal transfer printer may be used. Also in this embodiment, a multi-print has been used for description, but the printer is not limited to this, but it, of course, can be applied to ordinary thermal transfer recording using one-time ink sheet.

Further in the above-mentioned embodiment, though described when a thermal transfer printer was applied to a facsimile apparatus, the thermal transfer recording apparatus of the present invention is not limited to this, but can be applied, for example, to word processors, typewriters or duplicating machines.

In the case of a typewriter, etc., for example, both when data for a memory is continuously printed, and when data to be input by an operator is printed on the input, it can be carried out in the same way by changing the n value.

As the recording medium,.not only recording sheet but also any material capable of transferring ink such as cloth and plastic sheet can be used. Also the ink sheet is not limited to the roll construction shown in the embodiment, but a so-called ink sheet cassette type, etc., may be used in which the ink sheet is, for example, contained in a frame, which can be attached and detached within the recording apparatus main body, and this entire cassette is attached and detached from the recording apparatus main body.

The conveyance of ink sheet may be performed by winding the ink sheet by the ink sheet wind-up roller.

According to the present invention as described above, both when the recording period varies for recording and when the recording period is kept always constant for recording, the image can be recorded without deterioration in the quality of the picture even if the recording period varies by changing, for printing, the amount of conveyance of the ink sheet against the recording medium.

Also in the case of a facsimile apparatus, since the amount of conveyance of the ink sheet against the recording medium is changed for recording by selecting either recording the image data stored in the storage means or recording by synchronizing with the received image signal, reproduction in good quality of picture can be obtained in either case.

What is claimed is:

1. A thermal transfer recording apparatus, which records an image on a recording medium by transferring ink of an ink sheet on said recording medium, comprising:

conveyance means for conveying said ink sheet in a first direction by a first amount and conveying said recording medium in a second direction by a second amount;

recording means for recording an image on said recording medium by operating on said ink sheet;

detection means for detecting whether the recording is intermittent or continuous and outputting a detection result; and control means for changing the first amount of conveyance of said ink sheet by said conveyance means in accordance with said detection result.

2. A thermal transfer recording apparatus according to claim 1, wherein said first amount of conveyance of said ink sheet is smaller when said detection result indicates continuous recording than when said detection result indicates intermittent recording.

3. A thermal transfer recording apparatus according to claim 1, wherein said first amount of conveyance of said ink sheet is decreased to be less than that for intermittent recording when said detection result indicates continuous recording.

4. A thermal transfer recording apparatus according to claim 1, wherein said detection means detects whether or not the recording is intermittent by detecting whether or not an image data is intermittently provided.

5. A thermal transfer recording apparatus according to claim 1, wherein said first direction of said ink sheet is opposite to said second direction of said recording medium.

6. A thermal transfer recording apparatus according to claim 1, wherein said recording means operates on said ink sheet while said recording medium and said ink sheet have a relative speed therebetween.

7. An apparatus according to claim 1, wherein said apparatus is a facsimile apparatus having a receiving mechanism for receiving recording information from an outside source.

8. A thermal transfer recording apparatus, which records an image on a recording medium by transferring ink of an ink sheet on said recording medium, comprising:

ink sheet conveyance means for conveying said ink sheet in a first direction by an amount relative to said recording medium;

a recording medium conveyance means for conveying said recording medium;

recording means for recording an image on said recording medium by operating on said ink sheet which is conveyed by said ink sheet conveyance means;

detection means for detecting whether or not an image data to be recorded intermittently occurs and providing a detection result; and control means for controlling recording by changing the amount of conveyance of said ink sheet relative to said recording medium in accordance with the detection result of said detection means.

9. A thermal transfer recording apparatus according to claim 8, wherein said recording means records an image on said recording medium while said recording medium and said ink sheet have a relative speed therbetween.

10. An apparatus according to claim 8, wherein said recording medium is conveyed in a direction which is opposite to said first direction.

11. An apparatus according to claim 8, wherein said apparatus is a facsimile apparatus having a receiving mechanism for receiving recording information from an outside source.

12. An apparatus according to claim 8, wherein said amount by which said ink sheet is conveyed has a value which is greater during recording when said detecting means detects that the image data to be recorded is provided intermittently than when said detecting means does not detect that the image data to be recorded is provided intermittently.

13. A thermal transfer recording apparatus according to claim 8, wherein the ink sheet is conveyed by a first conveyance amount and the recording medium is conveyed by a second conveyance amount, said first conveyance amount differing from said second conveyance amount when the ink sheet and the recording medium are conveyed in different directions during recording.

14. A thermal transfer recording apparatus, which records an image on a recording medium by transferring ink of an ink sheet on said recording medium, comprising:

transmitting and receiving means for transmitting and receiving an image signal as an image data;

storage means for storing a received image signal;

ink sheet conveyance means for conveying said ink sheet by an amount relative to said recording medium;

recording medium conveyance means for conveying said recording medium;

recording means for recording an image on said recording medium by operating on said ink sheet which is conveyed by said ink sheet conveyance means;

detection means for detecting whether the image data stored in said storage means will be recorded or recording will be performed by synchronizing with the received image signal by said transmitting and receiving means and having a detection result; and control means which controls recording by changing the amount of conveyance of said ink sheet relative to said recording medium in accordance with the detection result of said detection means.

15. A recording apparatus according to claim 14, wherein said recording means records an image on said recording medium while said recording medium and said ink sheet have a relative speed therebetween.

16. An apparatus according to claim 14, wherein said apparatus is a facsimile apparatus having a receiving mechanism for receiving recording information from an outside source.

17. An apparatus according to claim 14, wherein said amount by which said ink sheet is conveyed is greater during recording when said detection means detects that the image data to be recorded is provided intermittently than when said detection means does not detect that the image data to be recorded is provided intermittently.

18. A thermal transfer recording apparatus according to claim 14, wherein the ink sheet is conveyed by a first conveyance amount and the recording medium is conveyed by a second conveyance amount, said first conveyance amount differing from said second conveyance amount when the ink sheet and the recording medium are conveyed in different directions during recording.

19. A thermal transfer recording apparatus for transferring an ink of an ink sheet onto a recording medium, to record an image and using a recording head which acts on said ink sheet to record said image, comprising:

transmitting and receiving means for transmitting and receiving an image signal;

storage means for storing a received image signal as an image data;

ink sheet conveyance means for conveying said ink sheet by an amount relative to said recording medium;

recording medium conveyance means for conveying said recording medium;

detection means for detecting whether the image data stored in said storage means will be recorded or recording will be performed by synchronizing with the received image signal by said transmitting and receiving means and having a detection result; and control means for changing the amount of conveyance of said ink sheet relative to said recording medium in accordance with the detection result of said detection means.

20. A thermal transfer recording apparatus according to claim 19, wherein said recording head records said image on said recording medium while said recording medium and said ink sheet have a relative speed therebetween.

21. A thermal transfer recording apparatus according to claim 17, wherein said apparatus is a facsimile apparatus having a receiving mechanism for receiving recording information from an outside source.

22. A thermal transfer recording apparatus according to claim 19, wherein said amount by which said ink sheet is conveyed is greater during recording when said detection means detects that the image data to be recorded is provided intermittently than when said detection means does not detect that the image data to be recorded is provided intermittently.

23. A thermal transfer recording apparatus according to claim 19, herein the ink sheet is conveyed by a first conveyance amount and the recording medium is conveyed by a second conveyance amount, said first conveyance amount differing from said second conveyance amount when the ink sheet and the recording medium are conveyed in different directions during recording.

24. A thermal transfer recording method for recording an image on a recording medium by transferring an ink from an ink sheet to said recording medium, comprising the steps of:

conveying said ink sheet in a first direction by an amount relative to said recording medium;

conveying said recording medium;

recording said image on said recording medium by operating on said ink sheet which is conveyed;

detecting an occurrence of an image data to be recorded intermittently and providing a detection result; and controlling said recording by changing an amount of said conveying of said ink sheet relative to said recording medium according to the result of said detecting.

25. A thermal transfer recording method according to claim 24, wherein, said image is recorded on said recording medium while said recording medium and said ink sheet have a relative speed therebetween.

26. A thermal transfer recording method according to claim 24, wherein the ink sheet is conveyed by a first conveyance amount and the recording medium is conveyed by a second conveyance amount, said first conveyance amount differing from said second conveyance amount when the ink sheet and the recording medium are conveyed in different directions during recording.

27. A thermal transfer recording apparatus, which records an image on a recording medium by transferring ink of an ink sheet on said recording medium, comprising:

ink sheet conveyance means for conveying said ink sheet by an amount relative to said recording medium;

a recording medium conveyance means for conveying said recording medium;

recording means for recording an image on said recording medium by operating on said ink sheet which is conveyed by said ink sheet conveyance means;

detection means for detecting whether the recording is intermittent or continuous and providing a detection result; and control means for controlling the recording by changing the amount of conveyance of said ink sheet relative to said recording medium in accordance with the detection result of said detection means.

28. A thermal transfer recording apparatus, which records an image on a recording medium by transferring ink of an ink sheet on said recording medium, comprising:

receiving means for receiving an image signal;

storage means for storing a received image signal as an image data;

ink sheet conveyance means for conveying said ink sheet by an amount relative to said recording medium;

recording medium conveyance means for conveying said recording medium;

recording means for recording an image on said recording medium by operating on said ink sheet which is conveyed by said ink sheet conveyance means;

detection means for detecting whether the recording is intermittent or continuous by said receiving means and outputting a detection result; and control means which controls the recording by changing the amount of conveyance of said ink sheet relative to said recording medium in accordance with the detection result of said detection means.

29. A thermal transfer recording apparatus for transferring an ink of an ink sheet onto a recording medium, for recording to an image and using a recording head which acts on said ink sheet to record said image, comprising:

receiving means for receiving an image signal;

storage means for storing a received image signal as an image data;

ink sheet conveyance means for conveying said ink sheet by an amount relative to said recording medium;

recording medium conveyance means for conveying said recording medium;

detection means for detecting whether the recording is intermittent or continuous by said receiving means and outputting a detection result; and control means for changing the amount of conveyance of said ink sheet relative to said recording medium in accordance with the detection result of said detection means.

30. A thermal transfer recording method for recording an image on a recording medium by transferring an ink from an ink sheet to said recording medium, comprising the steps of:

conveying said ink sheet by an amount relative to said recording medium;

conveying said recording medium;

recording said image on said recording medium by operating on said ink sheet which is conveyed;

detecting whether the recording is intermittent or continuous and providing a detection result; and controlling said recording by changing an amount of said conveying of said ink sheet relative to said recording medium according to the result of said detecting.

31. A thermal transfer recording apparatus, which records an image on a recording medium by transferring ink of an ink sheet on said recording medium, comprising:

ink sheet conveyance means for conveying said ink sheet by an amount relative to said recording medium;

a recording medium conveyance means for conveying said recording medium;

recording means for recording an image on said recording medium by operating on said ink sheet which is conveyed by said ink sheet conveyance means;

detection means for detecting whether the recording is intermittent or continuous and providing a detection result; and control means for controlling said ink sheet conveying means to change a relative conveyance speed of the recording medium and the ink sheet in accordance with the detection result of said detection means.

* * * * *

UNITED STATES PATENT AND TRADEMARK OFFICE

CERTIFICATE OF CORRECTION

PATENT NO. 5,576,751

DATED : November 19, 1996

INVENTOR(S) : SATOSHI WADA ET AL.

It is certified that error appears in the above-identified patent and that said Letters Patent is hereby corrected as shown below:

COLUMN 1

Line 37, "proposed" should read --proposed in--.
Line 66, "constant" should read --constant,--.

COLUMN 2

Line 62, "flowcharts." should read --flowcharts showing the receiving process for facsimile signals in the facsimile apparatus of this embodiment.--

COLUMN 3

Line 42, "a" should read --an--.
Line 43, "substitutes" should read --substitute--.

COLUMN 4

Line 15, "rolled paper" should read --paper roll--.

COLUMN 7

Line 44, "therebetween, or" should read --therebetween.--
Lines 45 and 46 should be deleted.
Line 53, "head. 13" should read --head 13--.

UNITED STATES PATENT AND TRADEMARK OFFICE

CERTIFICATE OF CORRECTION

PATENT NO. 5,576,751

DATED : November 19, 1996

INVENTOR(S) : SATOSHI WADA ET AL.

It is certified that error appears in the above-identified patent and that said Letters Patent is hereby corrected as shown below:

COLUMN 9

Line 65, "medium,.not" should read --medium, not--.

COLUMN 11

Line 16, "therbetween." should read --therebetween.--
Line 42, "image signal as an image data;" should read --image signal;--.
Line 44, "image signal;" should read --image signal as an image data;--.

COLUMN 12

Line 53, "herein" should read --wherein--.

COLUMN 13

Line 7, "wherein," should read --wherein--.

UNITED STATES PATENT AND TRADEMARK OFFICE

CERTIFICATE OF CORRECTION

PATENT NO. 5,576,751

DATED : November 19, 1996

INVENTOR(S) : SATOSHI WADA ET AL.

It is certified that error appears in the above-identified patent and that said Letters Patent is hereby corrected as shown below:

COLUMN 14

Line 5, "to" should be deleted.

Signed and Sealed this

Thirteenth Day of May, 1997

*Attest:*

*Attesting Officer*

BRUCE LEHMAN

*Commissioner of Patents and Trademarks*